US005859563A

United States Patent [19]

Yung et al.

[11] Patent Number: 5,859,563

[45] Date of Patent: Jan. 12, 1999

[54] LOW-NOISE LOW-IMPEDANCE VOLTAGE REFERENCE

[75] Inventors: Henry Tin-Hang Yung, Richardson; Steve Wiyi Yang, Plano; Michael J. Tsecouras, Carrolton, all of Tex.

[73] Assignee: Texas Instruments Incorporated, Dallas, Tex.

[21] Appl. No.: 800,913

[22] Filed: Feb. 13, 1997

[51] Int. Cl.[6] ..... G05F 1/10

[52] U.S. Cl. ..... 327/538; 327/540; 327/563

[58] Field of Search ..... 323/280, 281; 327/538, 539, 540, 541, 542, 543, 551, 560, 561, 562, 563

[56] References Cited

U.S. PATENT DOCUMENTS 5,122,730 6/1992 Milberger et al. ..... 323/370
5,302,888 4/1994 Hellums et al. ..... 323/280

*Primary Examiner*—Timothy P. Callahan
*Assistant Examiner*—Jeffrey Zweizig
*Attorney, Agent, or Firm*—Alan K. Stewart; Wade James Brady, III; Richard L. Donaldson

[57] ABSTRACT

A voltage reference circuit includes: an amplifier A1 with low open loop output impedance, an output of the amplifier is coupled to a first input of the amplifier A1; and a first resistor R1 coupled between the output of the amplifier A1 and a reference node 30, the first resistor R1 has a resistance substantially equally to the low open loop output impedance, whereby a low frequency impedance at the reference node 30 is substantially equal to the resistance.

2 Claims, 1 Drawing Sheet

LOW-NOISE LOW-IMPEDANCE VOLTAGE REFERENCE

FIELD OF THE INVENTION

This invention generally relates to voltage references and, more particularly, to low-noise low-impedance voltage references.

BACKGROUND OF THE INVENTION

For many applications, it is desirable to have an on-chip voltage reference that has low impedance from low to high frequencies. This often requires the use of external capacitors to maintain low impedance at high frequencies. One possible implementation is the prior art voltage reference circuit shown in FIG. 1, where a transconductance amplifier 20, with input transconductance gm, is used as an output buffer. An on-chip capacitor 22 can be used to compensate the amplifier 20 so that it will be stable even without the external capacitor 24. Unfortunately, the output impedance at low frequencies, which is essentially given by 1/gm, is not very low. The output impedance can be lowered by increasing gm, at the expense of increasing die area and power. However, it would be difficult to compensate the amplifier 20 with an on-chip capacitor 22 of reasonable size. An alternative approach in CMOS technology is the prior art voltage reference circuit shown in FIG. 2, where a complementary source-follower 26 is used in open loop. Thus, there is no need to worry about stability. But the low-frequency power supply rejection is not very good. It is also more difficult to control the output voltage accurately because of the open-loop approach.

SUMMARY OF THE INVENTION

Generally, and in one form of the invention, a voltage reference circuit includes: an amplifier with low open loop output impedance, an output of the amplifier is coupled to a first input of the amplifier; and a first resistor coupled between the output of the amplifier and a reference node, the first resistor has a resistance substantially equally to the low open loop output impedance, whereby a low frequency impedance at the reference node is substantially equal to the resistance.

DESCRIPTION OF THE DRAWINGS

In the drawings.

Corresponding numerals and symbols in the different figures refer to corresponding parts unless otherwise indicated.

DETAILED DESCRIPTION OF PREFERRED EMBODIMENTS

Figure 1:
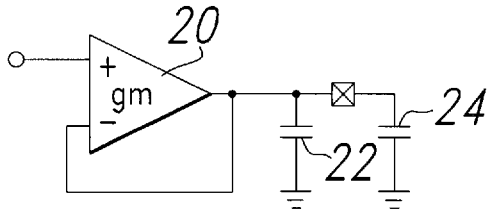
Fig. 1 PRIOR ART
FIG. 1 is a prior art voltage reference circuit.
Figure 2:
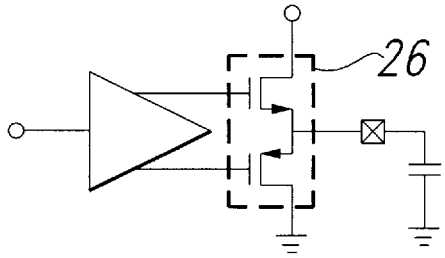
Fig. 2 PRIOR ART
FIG. 2 is a prior art voltage reference circuit.
Figure 3:
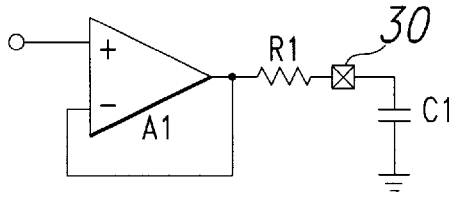
FIG. 3 is a diagram of a first preferred embodiment voltage reference circuit.

A first preferred embodiment voltage reference circuit is shown in FIG. 3. The circuit of FIG. 3 includes amplifier A1, resistor R1, capacitor C1, and reference node 30. The Amplifier A1 has low open-loop output impedance and can have, for instance, a complementary source-follower output stage. Since the amplifier A1 is operating in close loop, the effective output is very small at low frequencies (e.g. 0.001 Ohm). At high frequencies, the amplifier A1 loses its gain and its effective output impedance is reduced to its open-loop output impedance. The value of the resistor R1 is chosen such that it is comparable to the DC open-loop output impedance of the amplifier A1, which is quite low (e.g. 50 Ohms). Thus, the low-frequency impedance at the reference node 30 is essentially given by R1. The resistor R1 allows the amplifier A1 to remain stable, with or without the external capacitor C1. The capacitor C1 allows the reference node to have low impedance at high frequencies. In addition, R1 and C1 form a low-pass filter that filters out the high-frequency noise from the amplifier A1. Since the amplifier A1 is in close loop, the low-frequency power supply rejection is very good and the output voltage can be controlled well.

Figure 4:
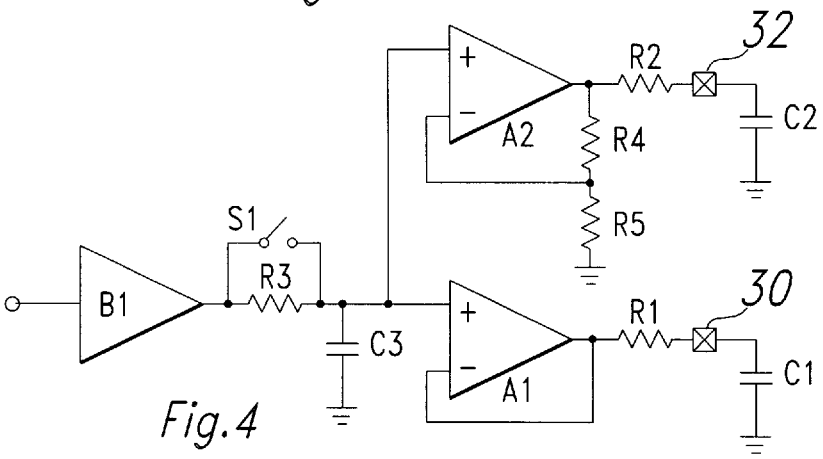
FIG. 4 is a diagram of a second preferred embodiment voltage reference circuit.

A second preferred embodiment voltage reference circuit is shown in FIG. 4. The circuit of FIG. 4 includes amplifier A1, resistor R1, capacitor C1, reference node 30, amplifier A2, resistors R2, R4, and R5, capacitor C2, reference node 32, buffer B1, resistor R3, switch S1, and capacitor C3. A very low pass filter is used to filter the reference voltage before feeding it to buffers low output impedance. The filter, implemented with R3 and C3, is used to get rid of most of the noise on the reference voltage. To implement a low cutoff frequency of, say 10 Hz or less, an external capacitor can be used for C3. The resistor R3 can be more than 1 Mega-Ohm. To save die area, it is possible to implement R3 with a MOS transistor with long channel length. The long power-up time for such a low pass filter can be reduced significantly by turning on a switch S1, which is in parallel with R3, during power-up until the filter output voltage is steady. As shown in FIG. 4, multiple buffers can be used in parallel to give multiple voltage references. The circuit of FIG. 4 provides voltage references at nodes 30 and 32. Node 32 provides a voltage gain by using resistors R4 and R5 in the feedback path of the amplifier A2.

A few preferred embodiments have been described in detail hereinabove. It is to be understood that the scope of the invention also comprehends embodiments different from those described, yet within the scope of the claims.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A voltage reference circuit comprising:

an amplifier with low open loop output impedance, an output of the amplifier is coupled to a first input of the amplifier;

a first resistor coupled between the output of the amplifier and a reference node, the first resistor has a resistance substantially equally to the low open loop output impedance, whereby a low frequency impedance at the reference node is substantially equal to the resistance;

a second resistor coupled to a second input of the amplifier;

a second capacitor coupled between the second input of the amplifier and ground; and a switch coupled between a first end of the second resistor and a second end of the second resistor.

2. The circuit of claim 1 further comprising a buffer, the second resistor is coupled between the second input of the amplifier and the buffer.

* * * * *